United States Patent [19]

Curran

[11] 4,096,790

[45] Jun. 27, 1978

[54] VENTILATION AND INSULATION BAFFLE

[76] Inventor: Laurence E. Curran, 460 E. High Point, Peoria, Ill. 61614

[21] Appl. No.: 809,528

[22] Filed: Jun. 24, 1977

[51] Int. Cl.[2] ..... F24F 7/00

[52] U.S. Cl. ..... 98/37; 98/32; 98/42 R; 98/DIG. 6; 52/198

[58] Field of Search ..... 98/32, 37, 35, 42 R, 98/DIG. 6, 29; 52/198, 199, 302, 303, 11, 22, 92, 95, 105

[56] References Cited

U.S. PATENT DOCUMENTS

| | | | |
|---|---|---|---|
| 3,160,987 | 12/1964 | Pinkley | 52/95 |
| 3,196,773 | 7/1965 | Lorenz et al. | 98/32 |
| 3,683,785 | 8/1972 | Grange | 98/DIG. 6 |
| 3,777,649 | 12/1973 | Luckey | 98/29 |
| 3,863,553 | 2/1975 | Koontz | 98/32 |

*Primary Examiner*—William F. O'Dea
*Assistant Examiner*—Henry C. Yuen
*Attorney, Agent, or Firm*—Silverman, Cass & Singer, Ltd.

[57] ABSTRACT

A ventilation and insulation baffle is secured to the tops of the rafters in a building construction prior to placing the sheathing over the rafters to prevent insulation from blocking the soffit vents and to provide attic ventilation channels between the soffit vents and the attic. The baffle has a plurality of planar panels connected together by upstanding rectangular channels. The channels are spaced and sized to fit over the top of the rafters. The opposite free edges of each baffle have a half-formed rectangular channel to partially overlap the outer rafters and to support the panels therefrom. One edge of each of the panels includes an angularly disposed flap which is secured to the sill of the building to prevent insulation from entering the soffit from the interior of the building, but leaving an inner channel or passageway above each panel from the soffit into the interior of the structure.

2 Claims, 4 Drawing Figures

VENTILATION AND INSULATION BAFFLE

BACKGROUND OF THE INVENTION

The invention relates to a ventilation and insulation baffle for a roof construction and more particularly to a baffle which is easily mounted onto the rafters prior to placing the sheathing thereover to provide an air passage from the soffit to the interior of the structure, but preventing fluffy, easily blown insulation from entering the soffit from the structure.

Current government regulations require 50% of total attic ventilation to be located in a low part of the attic in new construction, which is almost always in the soffit. Furthermore, attic air ventilation is most effectively, easily and cheaply admitted via soffit ventilation: therefore, a strong practical preference for soffit ventilation exists; however, because of the growing need for energy conservation, today's residential construction also requires large amounts of attic floor insulation. Six inches of insulation is now the minimum amount of insulation for new residential construction, while the use of ten or more inches of insulation is increasingly becoming common.

There are a number of effective types of insulation in utilization today, but by far the most prevalent types are batt or blown fiberglass. Blown fiberglass is generally used by new construction builders because of its low cost, ease and speed of installation. The insulation, of whatever type, must be applied evenly across the total attic surface so that there are no thin spots or heat leaks. The most difficult area of the attic to properly insulate is the area adjacent to the eave, because there is very little room to work in due to the rafters or trusses angling to the sill to connect with the ceiling joist and to form the eave or roof overhang. It is important that a uniform space be left between the top of the insulation and the underside of the roof sheathing to allow a uniform and adequate amount of ventilation air to pass between the soffit vents and the interior of the attic. Thus, it is extremely important for the installer of the insulation to prevent the batts and especially the fluffy blown insulation from being forced into the space between the sills and the sheathing or into the soffit itself to block the soffit vents.

To facilitate the installation of insulation evenly across the area of the attic adjacent to the eave and the sill and to provide space for the passage of the attic ventilation air from the soffit, many types of insulation baffles have been developed. These baffles typically are of different configurations, different materials and installed in different manners, but each of the baffles is of a type which fits a single space between a pair of rafters and extends upward from the sill or attic surface between the rafters. Typically the baffles are installed after the roof sheathing has been installed over the tops of the rafters. The prior art baffles are relatively expensive and laborious to install, often are inaccurate in providing a uniform air space for the attic ventilation and may fail to prevent the overflow of insulation into the soffit.

U.S. Pat. No. 3,160,987 issued to Pinkley discloses an insulation baffle which is formed from sheet material and has lips or tabs which are bent into a configuration so that the baffle may be stapled or otherwise secured to the rafters. The baffle does not have any provisions for automatically and accurately positioning the baffle between the rafters while maintaining the spacing from the roof sheathing. The lower lip or tab 27a is not fastened to the sill which may allow insulation material to pass underneath the lip 27a into the soffit to block the ventilator 18. Each baffle must be individually positioned and secured between each pair of rafters.

The U.S. Pat. No. 3,863,553 issued to Koontz illustrates a similar type of insulation stop and ventilation baffle which is again placed between each pair of rafters and secured by nails or staples through side fold sections 31 into the rafter members. There are no means for automatically positioning the baffle in the correct position. Each baffle includes a pivotal tab 35 to prevent insulation from being blown into the soffit when it is installed. Again, the bottom free edge 25 of the baffle or 45 is not secured to the sill which may allow insulation material to be forced into the soffit.

U.S. Pat. No. 3,972,164 issued to Grange discloses an insulating member which is preformed, but also is adapted to be placed between each pair of rafters and to rest upon the sill and the ceiling of the structure. The members are bulky and cumbersome.

SUMMARY OF THE INVENTION

The above and other disadvantages of prior art ventilation and insulation baffles and techniques are overcome in accordance with the present invention by providing a lightweight, preformed baffle which is installed prior to installing the roof sheathing to the structure. The baffle comprises at least two planar panels connected between each panel by a rectangular upstanding channel adapted to fit over a rafter. Each free edge opposite the rectangular channel has at least a half-formed rectangular channel sized to support and allow the baffles to abut one to the other on adjoining rafters. Each panel includes an extension flap which is secured to the sill of the building between the rafters to block the insulation from escaping the interior of the attic space.

DESCRIPTION OF THE PREFERRED EMBODIMENTS

Figure 1:
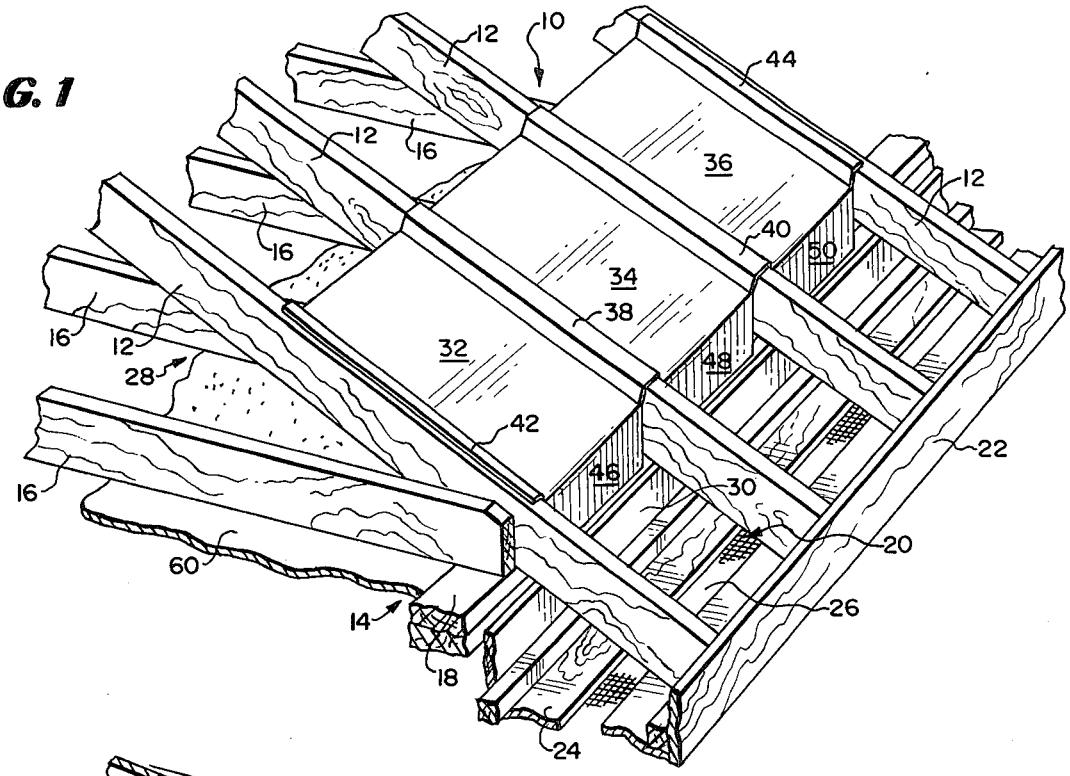
FIG. 1 is a perspective view of the ventilation and insulation baffle mounted on the rafters of a building structure which is partially illustrated.

Referring now to FIG. 1, the ventilation and insulation baffle of the invention is designated generally at 10 mounted on rafters 12 of a building structure 14 which is partially illustrated. The rafters 12 are conventionally spaced at a uniform distance apart such as 16 inches or 24 inches. The rafters 12 are secured at their lower ends to joists 16 and a sill 18. The rafters 12 extend beyond the sill 18 to form an overhanging eave 20.

A facia board or panel 22 abuts the ends of the rafters 12. A soffit 24 is secured between the building structure 14 and the facia 22. A vent 26 is provided in the soffit 24 to provide ventilation through the soffit 24 into the interior or attic 28 of the building structure 14. A wall 30 may be provided to seal the soffit 24 from the building structure 14.

The baffle 10 includes a plurality of planar panels 32, 34 and 36. The panels are joined one to another by rectangular channels 38 and 40 sized to fit over the rafters 12. The opposite free edges 42 and 44 of the baffle 10 are formed as bisected rectangular channels and sized so that adjacent baffles will abut one another toward the center of the adjoining rafter between the two baffles. It is feasible to have complete channels on the free edges which will produce an overlap, but the thickness resulting may bulge the sheathing, so this is not preferred.

Each of the planar panels 32 through 36 is thus automatically located a fixed and uniform distance below the upper surface of the rafters when the baffle 10 is installed on the rafters 12 prior to the sheathing being applied to the rafters 12. Each of the panels 32, 34 and 36 includes an extension or blocking flap 46, 48 and 50 joined at one edge of the panels at an angle. The junction will have some flexibility to enable adjustment of the angle. The flaps 46, 48 and 50 are secured to the front edge of the sill 18 to prevent insulation in the attic 28 from being blown or otherwise forced into the soffit vent 26 to block the air flow therefrom.

It is to be understood, of course, that similar baffles will be placed across all the rafters of the structure prior to applying the sheathing. The baffle 10 may thus easily be fitted and secured onto the rafters 12 and the sill 18 while the rafters and sill are uncovered and easily accessible.

Figure 2:
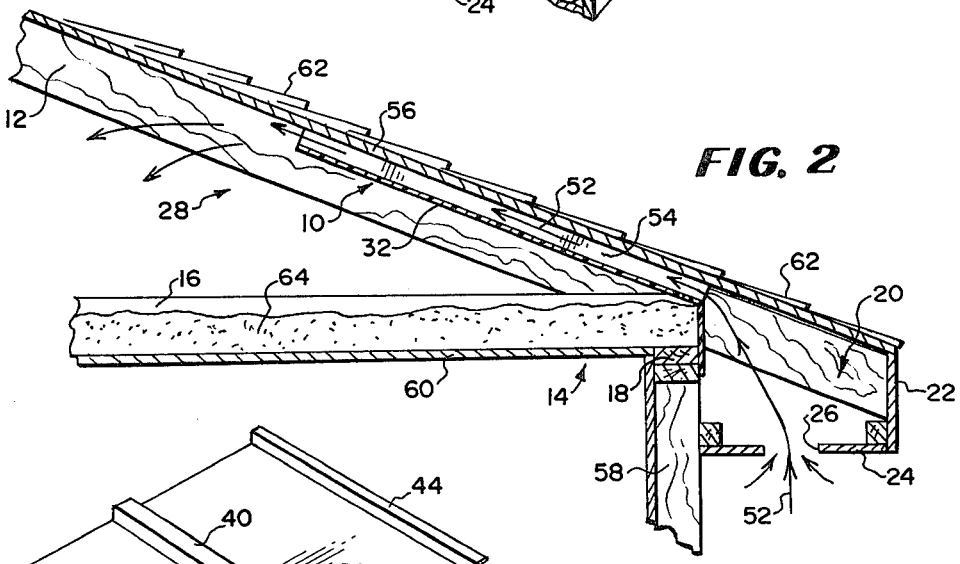
FIG. 2 is a more detailed sectional side view of the baffle mounted on a completed structure.

Referring now to FIG. 2, the completed structure is illustrated with the arrows 52 showing the flow of air through the soffit vent 26 and into a uniform and unblocked passageway 54 formed between the upper surface of the panel 32 of the baffle 10 and the lower surface of the sheathing 56. It is to be understood that there are substantially identical passageways over each panel, between each pair of rafters over which a baffle has been installed. The vent 26 may be provided with a screen or louvers and the sill 18 is mounted on the wall studs 58 to which the soffit 24 may also be directly attached.

A ceiling 60 is secured to the bottom of the joists 16 and forms the attic 28 between the ceiling 60 and the sheathing 56. The sheathing 56 is covered by a waterproof roofing material such as shingles 62. When the abovementioned construction has been completed insulation 64 will be blown or otherwise placed into position between each pair of rafters 16. The insulation 64 will be dispersed such that it forms a uniform layer between the rafters 16 above the ceiling 60 but will be prevented from blocking the soffit vent 26 by the blocking flap 46. The panels 32, 34 and 36 keep the respective passageways 54 clear of insulation. The blocking flaps 46, 48 and 50 are nailed or otherwise secured to the sill 18 so there is no possibility of the insulation 64 being blown or otherwise forced into the soffit vent 26.

Figure 3:
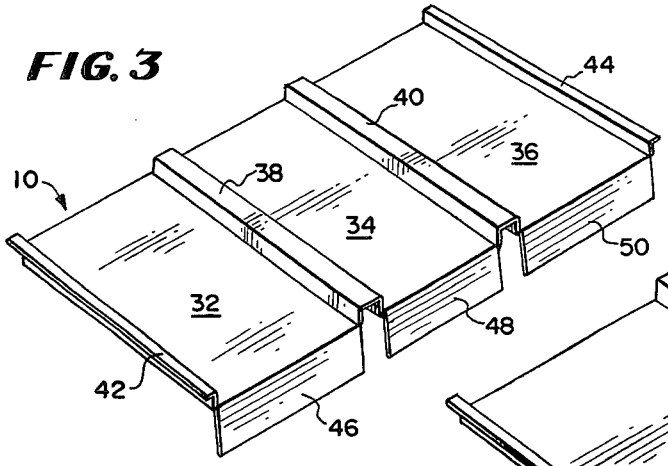
FIG. 3 is a perspective view of a three-panel baffle.

FIG. 3 illustrates a three-panel baffle 10, which in a conventional construction will have panels 32, 34 and 36 of a dimension 14 inches wide and 18 inches long with the channels 38 and 40 being 2 inches wide and 1 inch tall. The channels 38 and 40 may be made slightly larger to accommodate the minor imperfections in the uniformity between the spacing of the rafters 12. The flaps 46, 48 and 50 extend downward 4 inches and the half channels 42 and 44 will also be 1 inch high, but only 1 inch wide so that two baffles 10 may be abutted on a rafter. The baffle 10 is preferably made of plastic or resin impregnated cellulose approximately 0.019 inch thick which allows the baffle to be flexible, but is strong enough to form the desired passageways 54 and will not be deformed by the insulation material 64 and is impervious to water.

Figure 4:
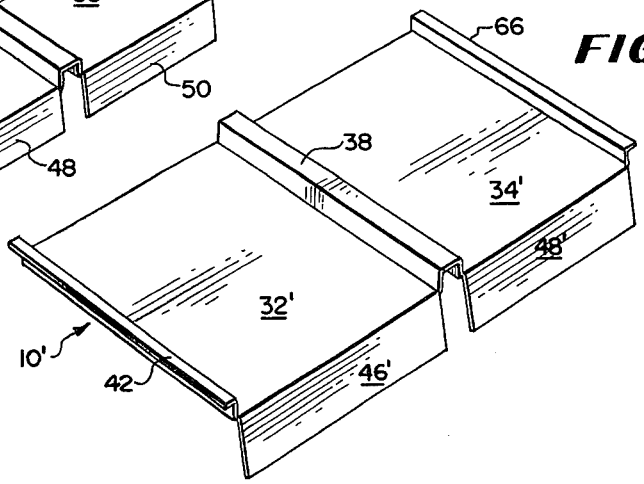
FIG. 4 is a view similar to FIG. 3 but of a two-panel baffle.

FIG. 4 illustrates a second embodiment of the baffle 10'. In this embodiment, the baffle is again 48 inches wide but the rafters 12 are spaced 24 inches from center to center rather than 16 inches from center to center and conveniently there are only the two panels 32' and 34' joined by single channel 38. The panel 34' now has a free edge 66 which is substantially identical to the channel 44 of the baffle 10. In this case the width of the panels 32' and 34' is 22 inches. The baffle 10 may of course be made in more than three panels and the dimensions of the planar panels may be varied depending upon the spacing of the rafters 12.

Many modifications and variations of the present invention are possible in light of the above teachings. It is, therefore, to be understood that within the scope of the appended claims, the invention may be practiced otherwise than as specifically described.

What is claimed and desired to be secured by Letters Patent of the United States is:

1. An insulation baffle for mounting over an exterior wall and between a roof and ceiling of a building structure to provide a ventilation passageway to an air space between the ceiling and roof and to prevent insulation which is subsequently applied to the ceiling from clogging said passageway, in which the exterior wall has a sill on which ceiling joists and inclined parallel roof rafters are supported, said rafters being spaced from each other a predetermined distance, said insulation baffle comprising:

a formed sheeting of substantially moisture impervious material, said sheeting including upper and lower surfaces, opposed side edges, and opposed end edges;

the width of said sheeting between the side edges thereof being generally a multiple of the predetermined distance between adjacent rafters;

said opposed side edges being laterally upwardly offset relative to the upper surface of the sheeting and defining predetermined height rafter overlying downwardly opening edge channel portions, each edge channel portion conforming to and being engageable with a substantial portion of the width of a rafter along the upper edge of the rafter for the full length of the side edge of the sheeting;

at least one integral intermediate upwardly offset downwardly opening rafter overlying channel defined across said sheeting parallel to and of equal height with the opposed side edge channel portions and spaced relative thereto, said intermediate channel conforming to and being engageable over the full width of a rafter along the upper edge of the rafter;

the sheeting between the edge channel portions and the intermediate channel forming planar panels of a width generally equal to the predetermined distance between adjacent rafters for engagement therebetween upon positioning of the edge channel portions and intermediate channel over adjacent rafters;

each of said planar panels having an integral full length extension along one end edge thereof, said extensions extending laterally downward from the lower surface of the sheeting for engagement with the sill between adjacent rafters whereby to block the movement of insulation particles from the interior of the structure past the sill.

2. An insulation baffle as claimed in claim 1 including multiple integral intermediate upwardly offset downwardly opening rafter overlying channels defined across said sheeting, the sheeting between adjacent intermediate channels forming planar panels of a width generally equal to the predetermined distance between adjacent rafters.

* * * * *